United States Patent [19]

Sommerfeld

[11] Patent Number: 5,038,843

[45] Date of Patent: Aug. 13, 1991

[54] VERTICAL BLIND WITH LOUVER ROTATION CONTROL

[75] Inventor: Dean R. Sommerfeld, Cottage Crove, Wis.

[73] Assignee: Graber Industries, Inc., Middleton, Wis.

[21] Appl. No.: 583,653

[22] Filed: Sep. 17, 1990

[51] Int. Cl.[5] ..... E06B 9/30

[52] U.S. Cl. ..... 160/176.1; 160/175; 160/168.1; 160/900

[58] Field of Search ..... 160/176.1, 177, 168.1, 160/173, 166.1, 172, 900, 178.1, 175

[56] References Cited

U.S. PATENT DOCUMENTS

| | | | |
|---|---|---|---|
| 2,116,357 | 5/1938 | Laborda et al. . | |
| 3,463,219 | 8/1969 | Osterholz | 160/172 |
| 3,996,938 | 12/1976 | de Wit | 160/168.1 |
| 4,122,884 | 10/1978 | Salzmann | 160/168.1 |
| 4,261,408 | 4/1981 | Debs | 160/176.1 |
| 4,262,728 | 4/1981 | Debs | 160/176.1 X |
| 4,507,831 | 4/1985 | McClure | 160/178.1 X |
| 4,936,369 | 6/1990 | Darner | 160/168.1 |

*Primary Examiner*—David M. Purol
*Attorney, Agent, or Firm*—Vernon J. Pillote

[57] ABSTRACT

A vertical blind of the type having louver carriages mounted for movement along a guide channel with a louver carrier mounted on each carriage for rotation about an upright axis and carriage gear mechanism for rotating the louvers in response to turning of an operating shaft that extends lengthwise of the channel. A wand operated mechanism is provided for rotating the louvers in response to raising and lowering a wand and includes a drive lever mounted for pivotal movement about an axis parallel to the axis of the operating shaft and a crank lever rotatable with the shaft and operated by the drive lever to rotate the shaft. A bidirectional detent mechanism on the housing and crank lever releasably retains the shaft in different angularly adjusted positions. The wand includes a tubular member connected to the drive lever through an L-shaped connector so that tubular member extends downwardly from the underside of the channel in all operating positions fo the drive lever.

10 Claims, 2 Drawing Sheets

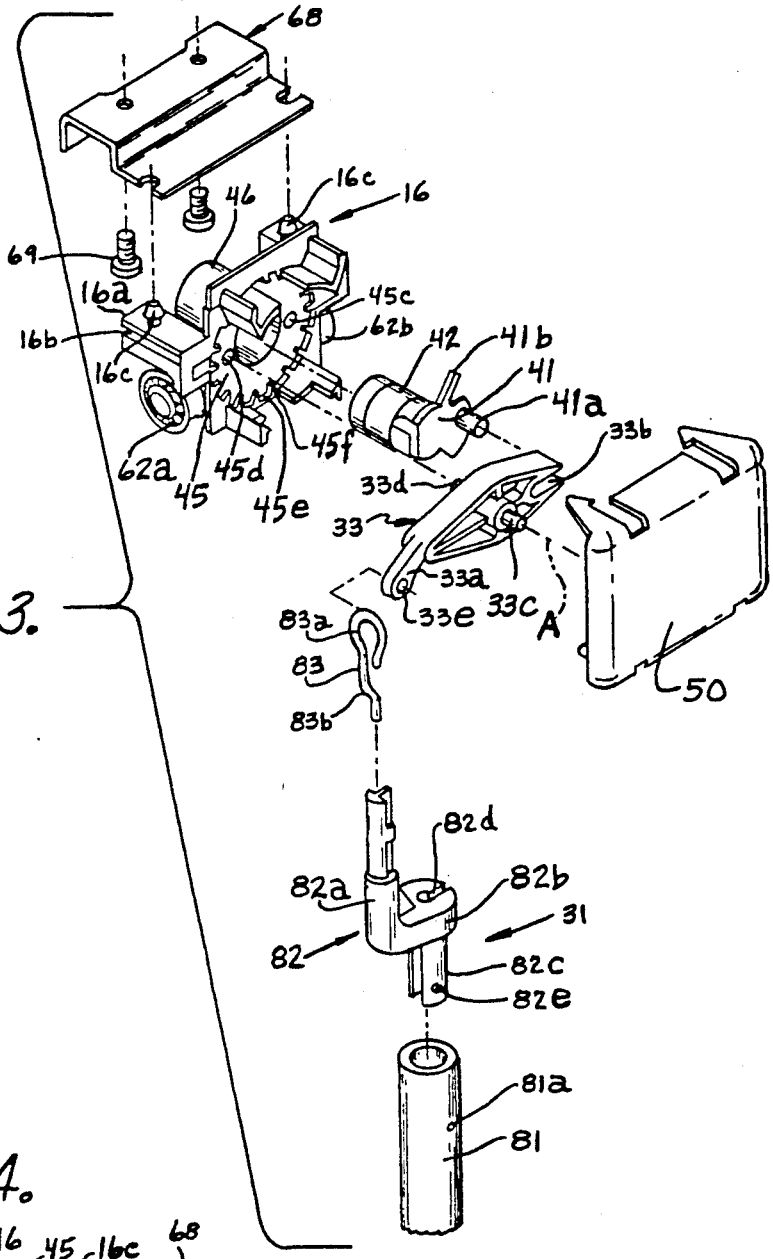
Fig. 3.
Fig. 4.
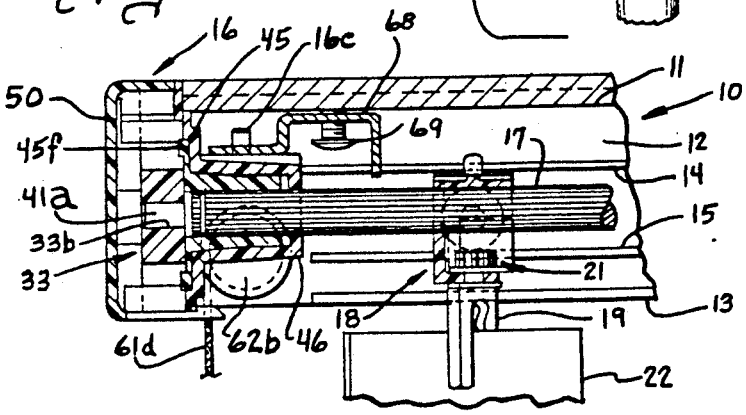

VERTICAL BLIND WITH LOUVER ROTATION CONTROL

BACKGROUND OF THE INVENTION

The present invention relates to an apparatus for rotating and traversing the slats in a vertical blind and particularly to improvements in the vertical blind with louver rotation control disclosed in U.S. Pat. No. 4,936,369, assigned to the assignee of the present invention. The '369 patent discloses a vertical blind of the type having a plurality of louver carriages mounted for movement along a guide channel, with a louver carrier mounted on each carriage for rotation about an upright axis and carriage gear mechanism for rotating the louvers in response to turning of an operating shaft that extends lengthwise of the channel, and a wand operated mechanism for turning the operating shaft in response to raising and lowering of a wand. The wand operated mechanism included a drive lever pivotally mounted on a housing at one end of the guide channel with one end of the drive lever adjacent one side of the channel and a wand attached to that end and extending downwardly therefrom for oscillating the drive lever through a first angle in response to upward and downward movement, and angular motion transmitting means interconnecting the drive lever and the operating shaft and operative in response to angular oscillation of the drive lever through the first angle to oscillate the operating shaft through a second angle substantially greater than the first angle. The carriage gear mechanisms on the louver carriages were constructed and arranged to rotate the associated louver carrier through an angle of substantially 180° in response to rotation of the operating shaft through the second angle. The wand was tubular and one of the operating cords for traversing the cords along the carrier guide channel extended through the tubular wand to separate the traverse cords an facilitate traversing of the carriage along the channel. In addition, the drive lever was arranged so that it could be reversibly mounted on the housing to enable positioning of the wand at either side of the channel, to adapt the blind for operation at either the left hand or the right hand of the blind.

In this prior apparatus, the louvers sometimes rotated from a previously adjusted position in response to a draft or breeze blowing against the louvers. In addition, the louvers sometimes rotated from an adjusted position when the operating cord was pulled in one direction or the other to traverse the slat carriers along the channel. Further, the wand in the prior apparatus was offset from the front side of the channel in all operating positions of the wand, and this not only adversely affected the appearance of the vertical blind but also caused the traverse cords to extend at a substantial angle as they entered the upper end of the wand.

SUMMARY OF THE INVENTION

It is an object of the present invention to overcome the disadvantages of the prior art by providing vertical blind with a wand operated louver rotation control having an improved arrangement for inhibiting rotation of the louvers from a preset position.

Another object of this invention is to provide a vertical blind with a wand operated louver rotation control having an improved arrangement for connecting the wand to the drive lever, to minimize projection of the wand at the front side of the blind.

BRIEF DESCRIPTION OF THE DRAWINGS

FIG. 3 is an exploded asymetric view of blind mechanism; and

FIG. 4 is a fragmentary horizontal sectional view through the vertical blind and blind operating mechanism.

DETAILED DESCRIPTION

Figure 1:
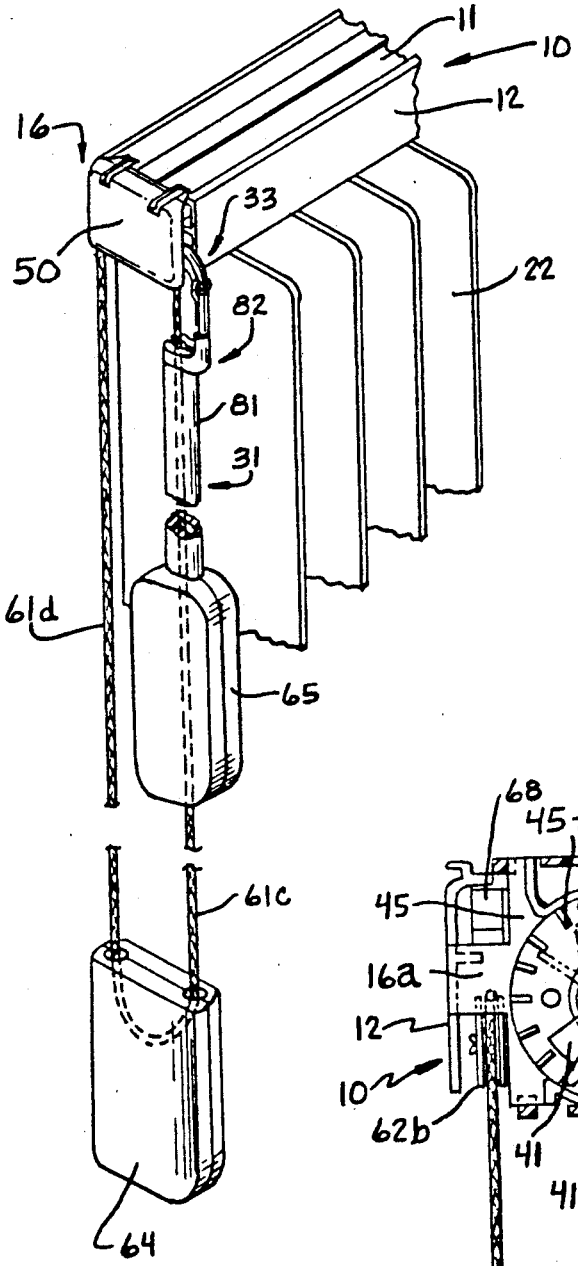
FIG. 1 is a fragmentary perspective view of a vertical blind embodying the present invention.

The vertical blind is of the type that includes a carriage guide channel 10 having a top wall 11, depending side walls 12 and a lengthwise extending opening 13 in the bottom. As best shown in FIG. 4, upper and lower guide rails 14 and 15 are provided on the side walls 12 for guiding the louver carriages 18 along the channel. A drive housing 16 is provided at one end of the channel and an operating rod 17 extends lengthwise of the channel and is supported at one end on the drive housing 16 and at the other end on a support member (not shown). A plurality of the louver carriages 18 are mounted on the guide channel for movement therealong and each has a louver carrier 19 mounted thereon for rotation about an upright axis and carriage gear means 21 engageable with the operating shaft 17 and with the associated louver carrier for rotating the louver carrier about the upright axis in response to rotation of the operating shaft. Louvers 22 are suspended from the louver carriers and, in order to move the louver carriers from a closed position in one direction to a fully opened position to a closed position in the opposite direction, it is necessary to rotate the louvers through substantially 180°. The operating shaft rotates all louvers through the individual carriage gear mechanisms and the operating shaft has a small cross section compared to the overall length of the vertical blind. In order to avoid the objectional angular displacement between the drive and the remote end of the operating shaft, which can cause non-uniform closing of the louvers, the carriage gear mechanism is preferably arranged to have a ratio of not substantially greater than 1:1 between the operating shaft and the louver carrier. In the embodiment shown, the carriage means is of the rack and pinion type disclosed in U.S. Pat. No. 4,122,884, the disclosure of which is incorporated herein by reference.

The drive housing 16 includes a wall portion 45 that extends across one end of the channel 10 and a sleeve portion 46 formed integrally with the wall portion 45. The drive housing 16 may be mounted on the channel 10 in any suitable manner and, in the embodiment illustrated, the drive housing is formed with side portions **16*a* having recesses or grooves 16*b* for receiving the upper rails 14 adjacent one end of the channel. The drive housing is anchored against movement of the channel by a metal clamp plate 68 that is mounted on posts 16*c* formed integrally with the side portions 16*a*, with clamp screws 69 threaded into the plate and arranged to engage the top wall 11** of the channel to lock the housing against movement out of the channel.

Figure 2:
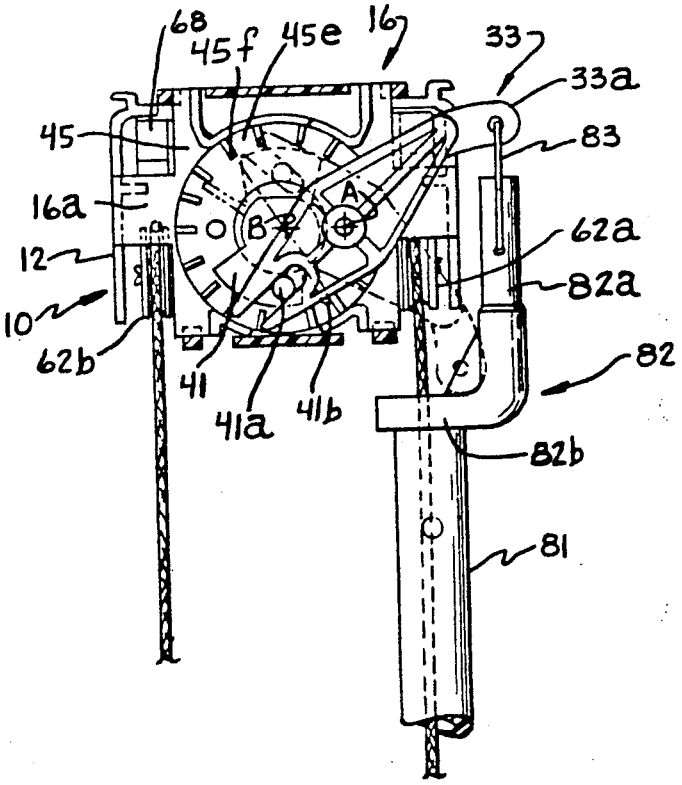
FIG. 2 is an end view of the blind operating mechanism with a cover removed.

The wand operated drive mechanism includes a drive lever 33 mounted on the drive housing for pivotal movement about a horizontal lever axis A parallel to the axis B of the operating shaft 17 (see FIG. 2). As disclosed in the '369 patent, the lever has trunnions 33*c* and 33*d* extending from opposite sides coaxial with the axis A and one of the trunnions 33*c* is adapted for reception in a socket 45*c* in the wall 45 of the housing to pivotally support the drive lever at one side of the shaft axis, and the other trunnion 33*d* is adapted for reception in a socket 45*d* to pivotally support the drive lever at the other side of the shaft axis B. A wand 31 is attached to one end 33*a* of the drive lever and, when the trunnion 33*c* is mounted in socket 45*c*, the wand 31 is disposed at one side of the channel 12 and, when the trunnion 33*d* is mounted in the socket 45*d*, the wand 31 is disposed at the other side of the channel.

The wand 31 is operatively to angularly oscillate the drive lever 33 in response to raising and lowering of the wand. However, the turning movement exerted by the wand on the drive lever dimishes to zero as the lever approaches either its top dead center or bottom dead center position with respect to the axis A and, in practice, the wand is only effective to oscillate the lever 33 through an angle substantially less than 180°, for example about 110° to 120°. An angular motion transmitting mechanism connects the drive lever 33 and the shaft 17 to rotate the shaft through a second angle substantially greater than the angular motion of the lever 33 sufficient to rotate the slats through 180° in response to movement of the drive lever through an angle substantially less than 180°. In the preferred embodiment illustrated, the angular motion transmitting mechanism includes a crank lever 41 having an internally splined hub 42 non-rotatably connected to one end of the operating shaft 17. The hub is rotatably supported in the sleeve portion 46 of the housing for turning with the operating shaft about the axis B of the shaft. The crank member has a crank pin 41*a* radially offset from the axis B of the operating shaft and the driver lever 33 is operatively connected to the crank pin 41*a* to rotate the crank and operating shaft. For this purpose, the drive lever 33 has a crank pin groove 33*b* which slidably receives the crank pin 41*a*.

The louver carriages 18 are traversed along the channel by a cord type traverse mechanism. As is conventional, the cord type traverse mechanism includes a traverse cord that is entrained over cord guides such as pulleys 62*a*, 62*b* on the drive housing 16, with generally horizontal runs of the traverse cord extending lengthwise of the channel and entrained over a cord guide (not shown) at the other end of the channel, and with the ends of the traverse cords connected to one or more lead carriages to move the same along the channel. The traverse cord also has an operating loop including runs 61*c* and 61*d* that extend downwardly from the cord guides 62*a* and 62 *b*. As is conventional, a cord weight 64 (FIG. 1) is provided at the bottom of the operating loop to weight the loop and guide the operating runs of the cords 61*c* and 61*d* at the lower end of the loop.

It had been found that a draft or breeze acting on of the vertical louvers tends to cause the louvers hence the operating shaft 17 to rotate from a preset position. In accordance with the present invention, a bi-directional detent means is provided for releasably retaining the operating shaft in different angular positions while permitting the drive lever to rotate the shaft in response to upward and downward movement of the wand. As best shown in FIGS. 2 and 3, a plurality of detent pockets 45*e* are formed on the wall 45 of the housing in an arc concentric with the axis B of the operating shaft, and a resilient detent finger 41*b* is formed on the crank lever 41 to coact with the detent pockets for releasably retaining the shaft in different angularly adjusted positions. As shown, detent pockets are formed between circumferentially spaced teeth 45*f* on the end wall 45 and the teeth and pockets are advantageously arranged in a circular locus spaced outwardly from the path of travel of the crank pin 41*a*. The housing is preferably molded of a synthetic resin material and the teeth and pockets 45*f* and 45*e* are formed integrally with the wall 45. The crank lever 41 is also preferably molded of a resilient synthetic resin material and the detent finger 41*b* formed integrally therewith and arranged to extend generally radially outwardly from the axis B of the operating shaft, at a location angularly spaced from the crank pin 41*a*. Although the crank lever is only rotated through approximately 180° when turning the operating shaft and louvers through 180°, the detent pockets are arranged to extend through 360° to adapt the mechanism for operation with the drive lever 33 and wand 31 at either side of the channel 12. A cover 50 is detachably mounted on the housing 16 and overlies the drive lever 33 and aids in supporting the drive lever, as more fully disclosed in the '369 patent.

In accordance with another aspect of the present invention, the wand 31 includes a tubular portion 81 adapted to have one of the operating portions 61*c* or 61*d* of the traverse cords pass therethrough, and a wand connector member 82 for connecting one end of the tubular member 81 to the end 33*a* of the drive lever. The connector member has a generally L-shaped configuration including a first leg portion 82*a* that is swingably attached by a device 83 to the end 33*a* of the drive lever to extend downwardly adjacent one side of the housing, and a second leg portion 82*b* that extends laterally from the lower end of the first leg portion into underlying relation with the housing. An upper end of the tubular portion 81 is detachably connected to the second leg portion of the connector member at a location horizontally offset from the first leg portion and below an associated one of the cord guides 62*a*, 62*b*. As best shown in FIG. 3, a plug portion 82*c* is formed integral with the second leg portion 82*b* and extends downwardly therefrom and is detachably received in the upper end of the tubular end 81. The leg portion 82*b* and plug portion 82*c* have a passage 82*d* extending therethrough and which opens laterally at one side of the plug portion and leg portion so that an operating run 61*c* or 61*d* can be inserted laterally into the passage 82*d*. Projections such as 82*e* are provided on the plug portion and arranged to be received in openings 81*a* in the tubular member 81, to releasably retain the tubular member in assembled relation on the connector member. Similar openings 81*a* (not shown) are provided on the other end of the tubular member. With this arrangement, it is not necessary to disassemble the tubular portion 81 from the operating loop of the traverse cord when changing from left side or right side draw. It is only necessary to detach the tube 81 from the connector member 82 and reverse the drive lever and connector member 82 and thereafter reconnect the tubular member to the connector member. As in the device disclosed in the patent '369, a handle 65 is detachably secured to the lower end of the tubular member to facilitate operation of the wand.

The device 83 for attaching the connector member to the wand is arranged to allow pivotal movement of the connector member relative to the end 33*a* of the wand about an axis generally paralleling the axis A, and to also allow swinging of the wand from a position extending downwardly from the drive housing 16 to a position extending alongside the channel 12, for compact packaging. As shown, the device 83 is formed of wire and includes a hook portion 83*a* that is adapted to be received in an opening 33*d* in the drive lever and a lower end portion 83*b* that is detachably secured to the upper end of the leg 82*a* of the connector member 82. The device 83 can conveniently be of the form disclosed in U.S. Pat. No. 4,507,831.

From the foregoing it is believed that the construction and operation of the vertical blind with wand operated louver rotation control will be readily understood. The bi-directional detent means including the detent pockets 45*e* on the housing and the resilient detent finger 41*b* on the crank member 41 is operative to releasably retain the shaft in different angularly adjusted positions while permitting the drive lever to rotate the shaft in response to upward and downward movement of the wand. The connector member supports the upper end of the tubular portion 81 of the wand so that the tubular portion extends downwardly from the underside of the housing in all operative positions of the operating lever 33. This arrangement reduces projection of the operating wand from the front of the housing and also maintains the upper end of the tubular member 18 below a respective one of the cord guides so as to minimize the angle through which the operating portion extends between the cord guide and the upper end of the tubular member and correspondingly reduce the drag forces of the operating cord on the wand and which might cause the drive lever to move and change the angle of the louvers during traverse of the lower carriages.

The embodiments of the invention in which an exclusive property or privilege is claimed are defined as follows:

1. A vertical blind of the type including a horizontal carriage guide channel having laterally spaced sides and an opening along a bottom side thereof, a horizontal shaft extending lenghtwise of the guide channel, a plurality of louver carriages mounted on the guide channel for movement therealong and each having a louver carrier mounted thereon for rotation about an upright axis and carriage gear means engageable with the shaft and with the associated louver carrier for rotating the louver carrier about said upright axis in response to rotation of the shaft, a drive housing at one end of the guide channel, a shaft turning mechanism mounted on the housing for turning the shaft, and carriage traverse means for moving at least a lead one of the carriages along the channel, a member non-rotatably connected to the shaft and mounted on the housing for angular oscillation about an axis coaxial with the shaft, said shaft turning means including a drive lever and means mounting the drive lever on the housing for angular oscillation about a horizontal lever axis paralleling the shaft, the drive lever having one end adjacent one side of the channel and a wand attached to said one end of said drive lever and extending downwardly therefrom for bidirectionally oscillating said drive lever through a first angle of substantially less than 180° in response to upward and downward movement of the wand, angular motion transmitting mechanism interconnecting said drive lever and said member and operative in response to angular oscillation of said drive lever through said first angle to oscillate the shaft through a second angle substantially greater than said first angle, said gear means on the louver carriages being constructed and arranged to rotate the louver carriers through an angle of substantially 180° in response to rotation of said shaft through said second angle, and bidirectional detent means including means on the housing defining a plurality of detent pockets in an arc concentric with said shaft, and a resilient detent finger on said member coacting with said detent pockets for releasably retaining said shaft in different angularly adjusted positions while permitting the drive lever to rotate the shaft in response to upward and downward movement of the wand.

2. A vertical blind according to claim 1 wherein said resilient detent finger extends generally radially of the axis of oscillation of the member.

3. A vertical blind according to claim 1 wherein the member is formed of synthetic resin material and the resilient detent finger is integral with the member and extends generally radially of the axis of oscillation of the member.

4. A vertical blind according to claim 1 wherein said member comprises a crank lever having a crank pin means spaced from the axis of oscillation of the member, the lever axis of the drive lever being offset from the shaft and the drive lever having follower groove means arranged to receive the crank pin means, said detent means extending generally radially of the axis of oscillation of said crank lever at a location spaced from the crank pin means, said detent pockets being disposed in a circular locus concentric with the axis of oscillation of said member.

5. A vertical blind according to claim 4 wherein said crank lever is formed of synthetic resin material and said resilient detent finger is integral with said crank lever.

6. A vertical blind according to claim 1 wherein said carriage traverse means includes traverse cord means having first and second operating portions extending downwardly from the housing, said wand including an elongated tubular members, and a wand connector member, the wand connector member having a generally L-shaped configuration and including:

a) a first leg portion swingably attached at an upper end thereof to the drive lever and extending downwardly adjacent one side of housing; and b) a second leg portion extending laterally from a lower end of the first leg portion into underlying relation with the housing, means detachably connecting an upper end of the tubular member to the second leg portion at a location horizontally offset from the first leg portion, one of said operating portions of the cord means extending through said tubular member.

7. A vertical blind according to claim 6 wherein the means detachably connecting the upper end of the tubular member to the second leg portion includes a plug portion integral with the second leg portion and extending downwardly therefrom and detachably received in the upper end of the tubular member, the plug portion having a laterally opening passage therethrough for receiving said one of said operating portions of the cord means.

8. A vertical blind according to claim 1 wherein the drive lever and the means for mounting the drive lever is constructed and arranged such that the drive lever can be positioned with said one end thereof at either side of the housing, said detent pockets being arranged in a circular locus concentric with the axis of the shaft.

9. A vertical blind of the type including a horizontal carriage guide channel having laterally spaced sides and an opening along a bottom side thereof, a horizontal shaft having a longitudinal axis extending lengthwise of the guide channel, a plurality of louver carriages mounted on the guide channel for movement therealong and each having a louver carrier mounted thereon for rotation about an upright axis and carriage gear means engageable with the shaft and with the associated louver carrier for rotating the louver carrier about said upright axis in response to rotation of the shaft, a drive housing at one end of the guide channel, a shaft turning mechanism mounted on the housing for turning the shaft, and carriage traverse means for moving at least a lead one of the carriages along the channel, said shaft turning mechanism including a drive lever mounted on the housing for angular oscillation about a horizontal lever axis paralleling the shaft, the drive lever having one end adjacent one side of the channel and a wand attached to said one end of said drive lever and extending downwardly therefrom for oscillating said drive lever between a raised and a lower postion through a first angle of substantially less than 180° in response to upward and downward movement of the wand, angular motion transmitting mechanism interconnecting said drive lever and said shaft and operative in response to angular oscillation of said drive lever through said first angle to oscillate the shaft through a second angle substantially greater than said first angle, said gear means on the louver carriages being constructed and arranged to rotate the louver carriers through an angle of substantially 180° in response to rotation of said shaft through said second angle, said carriage traverse means including cord means having first and second operating portions extending downwardly from the housing, said wand including an elongated tubular member, and a wand connector member, the wand connector member having a generally L-shaped configuration and including:

a) a first leg portion swingably attached at the upper end thereof to the drive lever and extending downwardly adjacent one side of housing; and b) a second leg portion extending laterally from a lower end of the first leg portion into underlying relation with the housing, means detachably connecting an upper end of the tubular member to the second leg portion at a location horizontally offset from the first leg portion, one of said operating portions of the cord means extending through said tubular member.

10. A vertical blind according to claim 9 wherein the means detachably connecting the upper end of the tubular member to the second leg portion includes a plug portion integral with the second leg portion and extending downwardly therefrom and detachably received in the upper end of the tubular member, the plug portion having a laterally opening passage therethrough for receiving said one of said operating portions of the cord means.

* * * * *